US006121987A

United States Patent [19]

Sasaki et al.

[11] Patent Number: 6,121,987

[45] Date of Patent: Sep. 19, 2000

[54] THERMAL TRANSFER RECORDING APPARATUS

[75] Inventors: Naotaka Sasaki; Shunichi Kawamata, both of Kiryu; Kenji Sugaya, Kiryuoshi; Natsue Endo, Kiryu, all of Japan

[73] Assignee: Japan Servo Co., Ltd., Tokyo, Japan

[21] Appl. No.: 09/386,136

[22] Filed: Aug. 31, 1999

Related U.S. Application Data

[62] Division of application No. 08/839,365, Apr. 18, 1997, Pat. No. 5,982,405.

[30] Foreign Application Priority Data

| | | | |
|---|---|---|---|
| Apr. 18, 1996 | [JP] | Japan | 8-119550 |
| Apr. 18, 1996 | [JP] | Japan | 8-119551 |
| May 17, 1996 | [JP] | Japan | 8-146450 |

[51] Int. Cl.[7] ..... B41J 2/325

[52] U.S. Cl. ..... 347/176; 347/217

[58] Field of Search ..... 347/217, 171, 347/176; 400/237, 240, 120.01, 120.02, 120.04

[56] References Cited

U.S. PATENT DOCUMENTS

| | | |
|---|---|---|
| 4,704,615 | 11/1987 | Tanaka . |
| 5,611,629 | 3/1997 | Paranjpe . |
| 5,690,439 | 11/1997 | Sasaki et al. . |

FOREIGN PATENT DOCUMENTS

| | | | |
|---|---|---|---|
| 2-3364 | 1/1990 | Japan | 347/217 |
| 4325280 | 11/1992 | Japan . | |

*Primary Examiner*—Huan Tran

*Attorney, Agent, or Firm*—Birch, Stewart, Kolasch & Birch, LLP

[57] ABSTRACT

A thermal transfer recording apparatus suitable for reduction in production cost by the enhancement of operating properties of the thermal transfer recording apparatus and the miniaturization of apparatus and reduction in operational expenses. A first transfer ribbon for sequentially having a plurality of color ink resin layer sections arranged in a longitudinal direction to record a visual image, and a second transfer ribbon having alternately arranged precoating resin layer sections and protective coating resin layer sections in a longitudinal direction are alternately replaced to oppose it to a thermal head.

7 Claims, 7 Drawing Sheets

THERMAL TRANSFER RECORDING APPARATUS

This application is a division of Ser. No. 08/839,365, filed Apr. 18, 1997, now U.S. Pat No. 5,982,405.

BACKGROUND OF THE INVENTION

1. Field of the Invention

The present invention relates to a thermal transfer recording apparatus for utilizing thermal energy of a heat generating element provided on a thermal head to transfer ink of a transfer ribbon disposed oppositely to a recording sheet to record a desired visual image, and an improvement in the transfer ribbon used for the thermal transfer recording apparatus.

2. Description of the Related Art

In the thermal transfer recording apparatus for utilizing thermal energy of a heat generating element provided on a thermal head to transfer a color ink formed on a transfer ribbon to record a visual image, an improvement in recording quality and a reduction in operational expenses always constitute a technically important theme. In order to respond to such a theme as described above, in the past, in a melt type thermal transfer recording apparatus, a precoating resin is transferred to a surface of a recording sheet, before recording a visual image, to improve a transfer property of a color ink. Furthermore, and in a sublimation type thermal transfer recording apparatus, a precoating resin layer for forming a dye receiving layer is transferred to a surface of ordinary paper before recording a visual image to eliminate use of an expensive exclusive-use recording paper thus reducing operational expenses. Furthermore, alternatively, a resin layer for a protective coating is transferred to a recorded recording paper after a visual image has been recorded for the purpose of improving a surface gloss and preventing discoloring.

CONVENTIONAL EXAMPLE 1

One example of a transfer ribbon used for a thermal transfer recording apparatus according to a prior example 1 for the purpose of such an improvement as described above is shown in FIGS. 10 and 11. In a transfer ribbon 29 shown in FIG. 10, a white or transparent precoating resin layer P, color ink resin layers such as yellow Y, magenta M, cyan C, black BK are sequentially and repetitively arranged in a longitudinal direction with length p.

The color ink used comprises, for the melt type thermal transfer recording, a material in which a pigment is mixed into wax which is peeled off by heating. Furthmore, for the sublimation type thermal transfer recording, a dye which is diffused and sublimated by heating is used. Further, side zones are provided along the feeding direction of a transfer ribbon on opposite sides widthwise of the precoating resin layer sections P and the color ink resin layer sections. A head discrimination mark 30 for discriminating the head position of recording for one image plane is provided on one of the side zones while ink discrimination marks 31, 32, 33, 34 and 35 for discriminating the precoating resin layer P and the color ink resin layer sections are provided on the other of the side zones, these marks being provided at a fixed position.

In the case of a conventional transfer ribbon 36 shown in FIG. 11, color ink resin layer sections of yellow Y, magenta M, cyan C and black BK and transparent protective precoating resin layers F are sequentially repetitively arranged on a film-like heat resistant substrate in a longitudinal direction with an area including a recordable range. The constitution of the color ink resin layer sections is similar to that shown in FIG. 10. Further, size zones are provided on opposite sides widthwise of the color ink resin layer sections and the protective coating resin layer sections F along the feeding direction of a transfer ribbon 36. A head discrimination mark 30 is provided on one of the side zones for discriminating the head position of recording for one image plane while ink discrimination marks 32, 33, 34, 35 and 37 are provided on the other of the side zones for discriminating the color ink resin layer sections and the protective coating resin layer sections F, these marks being provided at a fixed position, similarly to the prior example shown in FIG. 10.

CONVENTIONAL EXAMPLE 2

In a thermal transfer recording apparatus using a transfer ribbon which sequentially constitutes color ink resin layer sections of two colors or more in a longitudinal direction on each page, as the technique of the prior example 2, even in the case where recording data with respect to the corresponding color ink resin layer section is not present in image data to be recorded, that section is fed without being used and discarded. This leads to a problem in that operational expenses are high. In order to solve this problem, Japanese Patent Publication No. Hei-2-3364 publication discloses a thermal transfer type color printer using a transfer ribbon in which a heat sensitive layer is provided on a substrate for the transfer ribbon.

The constitution of a transfer ribbon used for the aforementioned thermal transfer recording apparatus and a using example thereof are shown in FIGS. 12 and 13. In a transfer ribbon shown in FIG. 12, a heat sensitive layer which is colored by heating is uniformly provided on a transparent film-like substrate, on the upper layer of which are sequentially repetitively formed in length p color ink resin layer sections of yellow Y, magenta M, cyan C and black BK with an area including a recordable range. Head marks 30 for discriminating the head position of one page, that is, the head position of a yellow section are provided on one side zone widthwise of the color ink resin layer sections arranged in a longitudinal direction of the transfer ribbon 29, that is, in a feed direction of a transfer ribbon, while a recording track 38 for recording used information of the color ink resin layer sections is provided on the widthwise other side zone.

FIG. 13 shows the used state of the transfer ribbon 29 in the conventional thermal transfer recording apparatus. FIG. 13 shows that for example, as a result in which an image for one page was recorded, yellow Y was consumed by length YL, magenta M was consumed by length ML, cyan C was consumed by length CL, and black BK was consumed by length BL Since the transfer ribbon 29 is provided with a heating layer which is colored by heating on a transparent substrate, when a heat generating element of a thermal head opposite to the recording track 38 is energized similar to the recording of image data, coloring by the same length as the consuming length of the color ink resin layer sections is provided. Accordingly, for example, an optical sensor is installed as a sensor for detecting the coloring state, on the recording track 38, to discriminate a boundary of a shade portion caused by coloring and a transparent portion whereby a used portion and an unused portion of the color ink resin layer sections can be discriminated. As described above, when the consumption length YL of yellow Y has been discriminated and next image data is recorded and the recording length of yellow Y to be recorded is (p-YL), this yellow Y can be used again, thus improving the operational expenses in the thermal transfer recording.

As described above, in the thermal transfer recording apparatus according to the prior example 1, the ink resin layer sections of color Y, M, C and BK and the precoating resin layer section P or the protective coating resin layer section F are provided in a mixed manner on the one and same substrate, the transfer ribbon 29 or 36 used for recording. It is necessary to form a precoating resin layer section P or a protective coating resin layer section F different in composition from the color ink resin layer sections in the fabrication step. This causes the transfer ribbons 29 or 36 to lower the yield as the number of fabrication steps increases to increase the production expenses, resulting in an increase in operational expenses of the thermal transfer recording apparatus. Further, in the thermal transfer recording apparatus using these transfer ribbons 29 and 36, the transfer by the precoating resin layer section P before recording a visual image and the transfer by the protective coating resin layer section after recording cannot be recorded by a consistent process, and therefore it is necessary to exchange the transfer ribbons, 29, 36 manually when necessary. There poses a problem in that unmanned operation is difficult depending on the using conditions for a network.

Furthermore, in the case where the precoating resin layer section, the color ink resin layer sections and the protective coating resin layer sections are formed one and the same transfer ribbon by a cylinder system, it is necessary to use a cylinder which has a circumferential length not less than 6 p at a minimum. This makes apparatus for bonding ink and resin layer larger in size and increases equipment investing expenses. As a result, the transfer ribbon becomes higher in price and the operational expenses of the thermal transfer recording apparatus increase.

Further, in the thermal transfer recording apparatus according to the conventional example 2, there is required a track for installing the head mark 30 on one of the side zones of the color ink resin layer sections and the recording track 38 for writing used information on the color ink resin layer sections on the other, as shown in FIGS. 12 and 13. As a result, the width of the transfer ribbon becomes excessively widened. Further, it is necessary for writing used information of the color ink resin layer sections to have a thermal head wider in width than a fixed image recording range, making the entire apparatus larger in size to increase the price of the thermal transfer recording apparatus.

The prior art as described above impedes the popularization of the thermal transfer recording apparatus. In view of the aforementioned problems, it is an object of the invention to provide a thermal transfer recording apparatus, which enhances the thermal transfer recording performance by the melt type thermal transfer recording system or the sublimation thermal transfer recording system, improves the constitution of a transfer ribbon and the managing method for the used state of the transfer ribbon, enhances the operating properties and reduces the operational cost, and is small in size and reduces the cost of production.

SUMMARY OF THE INVENTION

For solving the problem noted in the conventional example 1, the present invention provides a thermal transfer recording apparatus for selecting a desired transfer ribbon from a plurality of transfer ribbons with respect to a single recording portion to feed it so as oppose to a thermal head to record information on a recording sheet, wherein in at least one of said plurality of transfer ribbons, white or transparent precoating resin layer sections which can be peeled off by heating and transparent protective coating resin layer sections are sequentially arranged in a longitudinal direction on a heat resistant substrate of a film Thermal transfer is carried out by the precoating resin layer sections before recording of a visual image by color ink resin layer sections relative to a recording sheet. The visual image is recorded on the recording sheet. After this, a thermal transfer is carried out by the protective coating resin layer sections.

Further, for solving the problem noted in the conventional example 2, a plurality of color ink resin layer sections are sequentially arranged in a longitudinal direction, there is provided a transfer ribbon comprising discrimination marks for color ink resin layer sections for recording a visual image on a recording sheet by heating and mark sections for recording information relating to used sections or unused sections of the transfer ribbon A recording control means has data processing means for outputting energization instructions to a heat generating element for heating and recording used or unused information of color ink resin layer sections on the mark sections from image data to be recorded. The recording portion is provided with detection means for detecting the used or unused information of the ink sections, and thermal transfer recording is carried out by the use of the unused sections on the basis of used or unused information of the ink sections detected by said detection means.

The transfer ribbon provided with only the color ink resin layer sections and the transfer ribbon having the precoating resin layer sections and the protective coating resin layer sections sequentially arranged can be separately used. The number of fabrication steps of the transfer ribbon is reduced whereby the yield of the transfer ribbon is enhanced, and the low cost of the transfer ribbon can be used without making the apparatus for bonding the resin layer larger in size. As a result, it is possible to provide a thermal transfer recording apparatus suitable for reducing the operational expenses. Further, since a discrimination mark for discriminating at least one of the precoating resin layer section and the protective coating resin layer section is provided, the thermal transfer recording apparatus can automatically discriminate the respective sections to execute the desired transfer processing.

Further, according to the thermal transfer recording apparatus of the present invention, the heat sensitive layer is provided on the transparent substrate of the transfer ribbon, and the use of the color ink resin layer sections or the writing of unused information can be made on the head mark section having substantially the same width as the color ink resin layer sections formed on the upper layer thereof. Since the unused portion of the color ink resin layer sections to be recorded on the basis of said information can be utilized, the transfer ribbon can be used economically without widening the width of the transfer ribbon as in the prior example 1. Further, the actual length of the thermal head used for the thermal transfer recording, and the reduction in operational expenses and the miniaturization can be attained. It is possible to provide a thermal transfer recording apparatus at the low cost.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

The preferred embodiments of the present invention will be described in detail with reference to the accompanying drawings.

<Embodiment 1>

Figure 1:
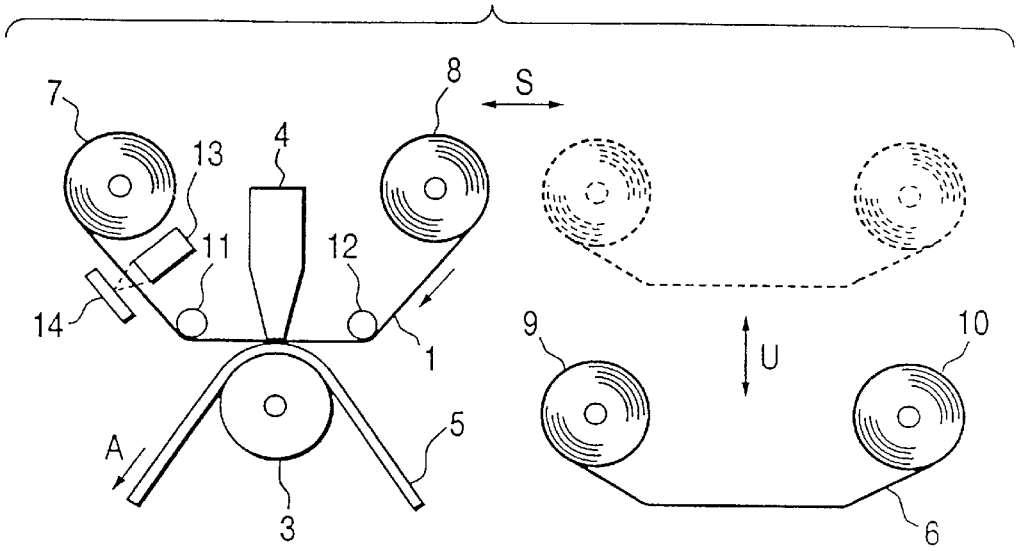
FIG. 1 is a plan view schematically showing a recording section according to Embodiment 1 of the thermal transfer recording apparatus of the present invention.

FIG. 1 is a plan view schematically showing a recording section according to Embodiment 1 of the thermal transfer recording apparatus of the present invention Referring to FIG. 1, a thermal head 4 has a row of heat generating elements having a dimension corresponding to a recording width arranged on an extreme end thereof. A transfer ribbon 1 and a recording sheet 5 are introduced so as to be sandwiched between the thermal head 4 and a platen roller 3. The transfer ribbon 1 is formed with resin layer sections having an area including a recordable range. A resin layer bonding surface of the transfer ribbon 1 is in close contact with the recording sheet 5. The thermal head 4 presses the platen roller 3 by a predetermined pressure.

The platen roller 3 is rotated in a direction indicated by an arrow A, and energization to the row of heat generating elements disposed on the thermal head 4 is repeated whereby recording information is transferred to the recording sheet 5 through a resin layer formed on the transfer ribbon 1.

The transfer ribbon 1 is applied with a predetermined tension by tension applying rods 11, 12 and transported from a supply roll 8 to a take-up roll 7. The transport channel of the transfer ribbon 1 is provided with a light emitting element 13 and a light receiving element 14 so that transmission or cutoff of light having passed through the transfer ribbon 1 can be detected. An optical sensor comprising the light emitting element 13 and the light receiving element 14 is arranged oppositely to a predetermined position so that discrimination marks provided on side zones of the transfer ribbon 1 can be detected. The thermal head 4 and the tension applying rods 11, 12 including the optical sensor are constituted integrally and can move up to a position beyond the take-up roll 7 and the supply roll 8 for the transfer ribbon 1.

On the other hand, a ribbon stocker for storing a separate transfer ribbon 6 is provided on the side of a recording mechanism portion constituted by the thermal head 4 and the platen roller 3, and the exchanging operation of the transfer ribbon 1 and the transfer ribbon 6 can be automatically carried out by a combination of movements in a direction of arrow U and in a direction of arrow S. For the transfer ribbon exchanging mechanism, there is a prior technique disclosed in Japanese Patent Application Laid-open No. Hei-8-164646.

Figure 2:
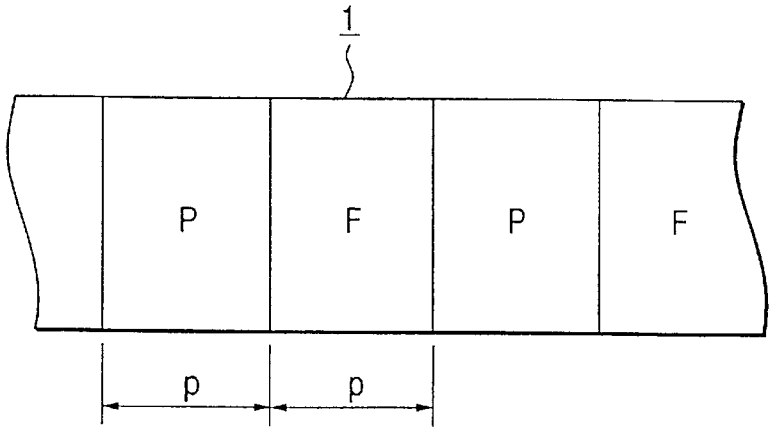
FIG. 2 is a view showing a first constitution of a transfer ribbon used in Embodiment 1 of the thermal transfer recording apparatus of the present invention.

As shown in FIG. 2, in the transfer ribbon 1, white or transparent precoating resin layer sections P and transparent protective coating resin layer sections F are sequentially disposed in a longitudinal direction with pitch of length p on a film-like heat resistant substrate having a width slightly beyond a recordable widths Since the transfer ribbon 1 has no color ink resin layer section, it can be fabricated by a relatively short step. Further, since the color ink resin layer sections are not damaged during the fabrication step as in the conventional transfer ribbons 29, 36, the yield reduction caused by the damage does not likely occur. Also in connection with the apparatus for bonding resin layers, the length for forming the resin layers is (p). In the case where a cylinder system resin bonding apparatus is used, a circumferential length is sufficient to substantially fulfill 2 p. As compared with the prior art in which the circumferential length of substantially 6 p is necessary, it is possible to miniaturize the resin layer bonding apparatus to reduce the equipment investing price.

An area of the precoating resin layer section P and the protective coating resin layer section F is slightly larger than the recordable range of the recording apparatus. Accordingly, the precoating resin layer section P is first thermally transferred to the entire recordable range of the recording sheet 5, and then the transfer ribbon 1 is automatically exchanged to transfer the transfer ribbon 6 to the recording mechanism portion. For the transfer ribbon 6 used to record a visual image, there is used a film-like heat resistant substrate having a width somewhat beyond the recordable width similarly to the substrate for the transfer ribbon 1. This heat resistant substrate is formed with ink resin layer sections in which four color inks of yellow Y, magenta M, cyan C and black BK are sequentially coated in a longitudinal direction, each having the same coating length p. Accordingly, the color ink resin layer sections each have an area slightly beyond the recordable range.

Ink material comprises a sublimation dye for sublimation recording, and a wax mixed with a pigment for melt type recording. Transparent side zones along the transport direction of the transfer ribbon 6 are provided on opposite sides of the color ink resin layer sections. At predetermined positions of one side zone are provided black head discrimination marks 24 for discriminating a head position for recording one image plane, whereas at predetermined positions of the other side zone are provided black ink discrimination marks 25, 26, 27 and 28 for discriminating color ink resin layers. These discrimination marks 24, 25 can be detected by the light emitting element 13 and the light receiving element 14. The take-up roll 9 and the supply roll 10 for the transfer ribbon 6 shown in FIG. 1 are controlled in rotation so as to rapidly carry out heading of the color ink resin layer sections.

In the transfer ribbon 6, heading of yellow Y is carried out, and recording of the yellow Y section is carried out while feeding the recording sheet 5 in a direction indicated by arrow A. Then, the recording sheet 5 is returned in a direction opposite the arrow A and located at a recording head position, and heading of the magenta M section of the transfer ribbon 6 is carried out. The recording sheet 5 is again transported in a direction of arrow A to record the magenta M section Afterward, similar operation is carried out also with respect to the cyan C section and the black BK section. When a visual image has been recorded, the transfer ribbon 6 is automatically exchanged again, and the transfer ribbon 1 is transferred to the recording mechanism portion to effect the thermal transfer by the protective coating resin layer section F on the entire recordable range of the recorded recording sheet 5.

Figure 3:
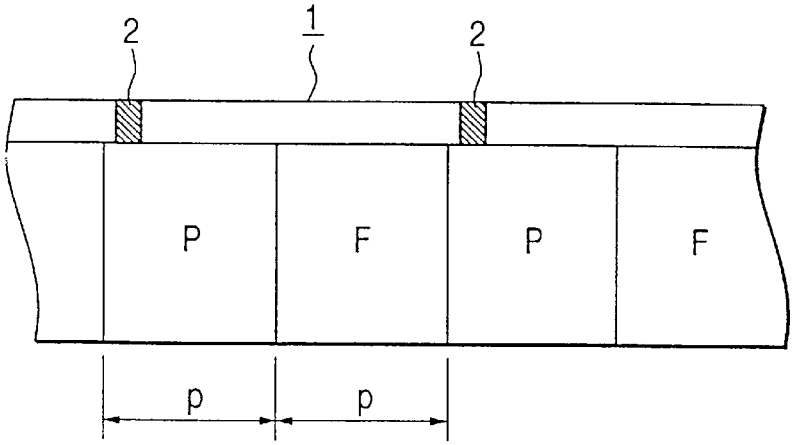
FIG. 3 is a view showing a second constitution of a transfer ribbon used in Embodiment 1 of the thermal transfer recording apparatus of the present invention.

In FIG. 3, if the precoating resin layer sections P are formed by a white material by the transfer ribbon 1, when the transfer ribbon 1 is charged into the recording mechanism portion, the recording can be started while visually setting a heading position However, it is preferable for enhancing the operating property of the recording apparatus to provide the head discrimination mark 2 at a predetermined position representative of the head of the precoating resin layer section P. In the arrangement of the head discrimination marks 2, the side zone along the feeding direction of the transfer ribbon 1 is made transparent, on which black head discrimination marks 2 may be applied. In a case where the precoating resin layer section P is white, a black head discrimination mark is provided directly on an unfilled portion of the precoating resin layer section P by making use of the nature of the optical sensor 13 which can detect a white reflecting light whereby the utilization efficiency of the transfer ribbon 1 can be enhanced.

While in the above-described Embodiment 1, a description has been made of the constitution in which the color ink resin layer sections of the transfer ribbon 6 used for recording a visual image comprise four colors comprising yellow Y, magenta M, cyan C and black BK, it is obvious that the constitution of three colors except black BK does not at all affect the operation and effect of the present invention, and even if the constitution of the discrimination marks are variously modified, the mechanism adapted to the object of the present invention is obtained.

Figure 4:
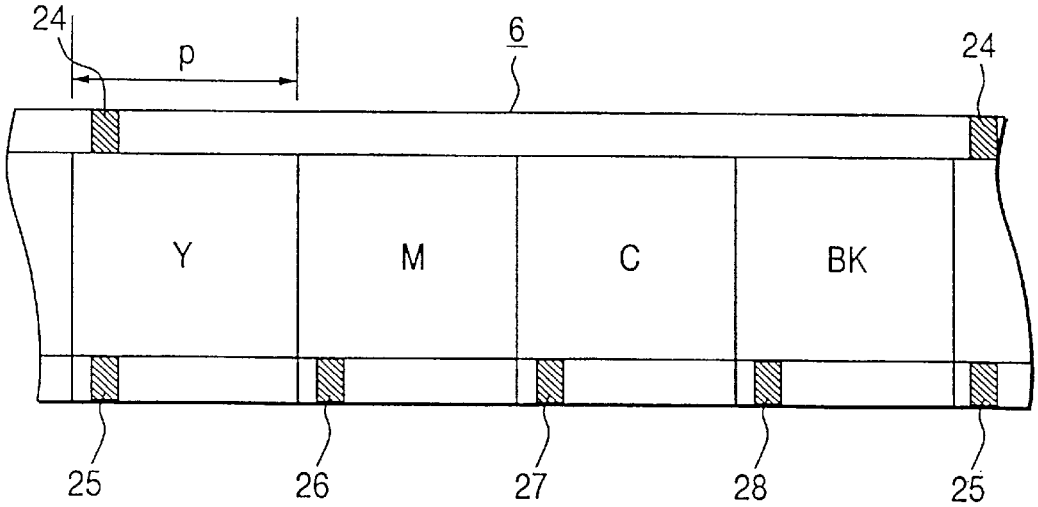
FIG. 4 is a view showing the constitution of a transfer ribbon used for recording a visual image in Embodiment 1 of the present invention.

It is to be noted that the first transfer ribbon according to claim 1 corresponds, for example, to a transfer ribbon 6 shown in FIG. 4, and a second transfer ribbon corresponds to the transfer ribbon 1 shown in FIG. 3. Further, needless to say, the transfer ribbon 1 may be used in replace of the transfer ribbon 2 and vice versa, and either one may be used singly.

Embodiment 2

Figure 5:
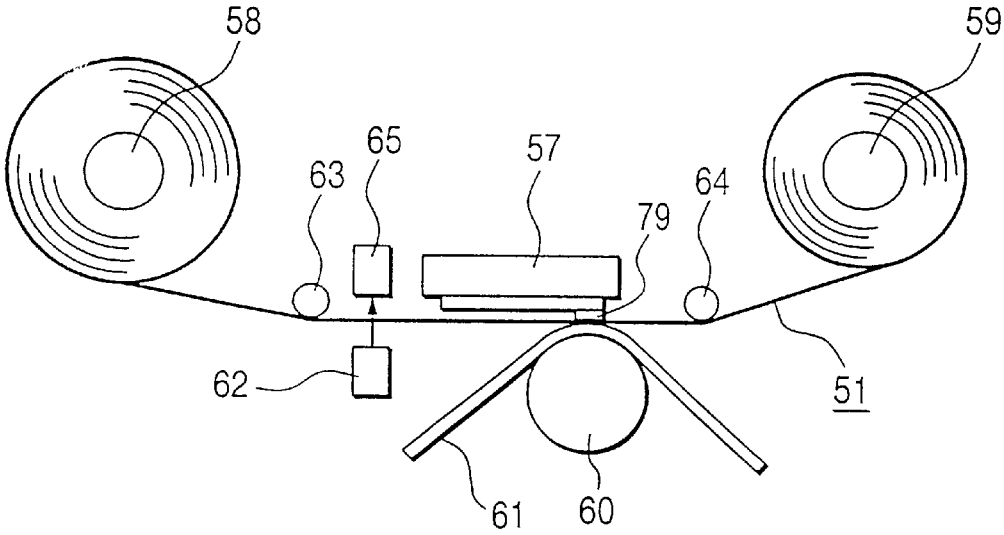
FIG. 5 is a plan view schematically showing a recording section according to Embodiment 2 of the thermal transfer recording apparatus of the present invention.

FIG. 5 is a plan view schematically showing a recording section according to Embodiment 2 of the thermal transfer recording apparatus of the present invention. In FIG. 5, a thermal head 57 has a row of heat generating elements 79 having a dimension corresponding to a recording width arranged at an extreme end thereof. A transfer ribbon 51 and a recording sheet 61 are introduced between the thermal head 57 and a platen roller 60. The transfer ribbon 51 is formed with color ink resin layer sections having an area including a recordable range. A resin layer bonding surface of the transfer ribbon 51 is in close contact with the recording sheet 61. The thermal head 57 presses the platen roller 60 by a predetermined pressure.

While rotating the platen roller 60 under this condition, energization to the heat generating elements 79 disposed on the thermal head 57 is repeated whereby color ink by the color ink resin layer sections is transferred to the recording sheet 61.

The transfer ribbon 51 is applied with a predetermined tension by tenson applying rods 63, 64 and transported from a supply roll 58 to a take-up roll 59. The transport channel of the transfer ribbon 51 is provided with a light emitting element 62 and a light receiving element 65 on substantially the same optical axis so that transmission or cutoff state of light having passed through the transfer ribbon 51 can be detected. Two sets of optical sensors comprising light emitting elements 62 and light receiving elements 65 are respectively arranged at predetermined positions close to both ends of a recording width of the transfer ribbon 51 so that discrimination marks described later provided on the transfer ribbon 1 can be detected.

Figure 6:
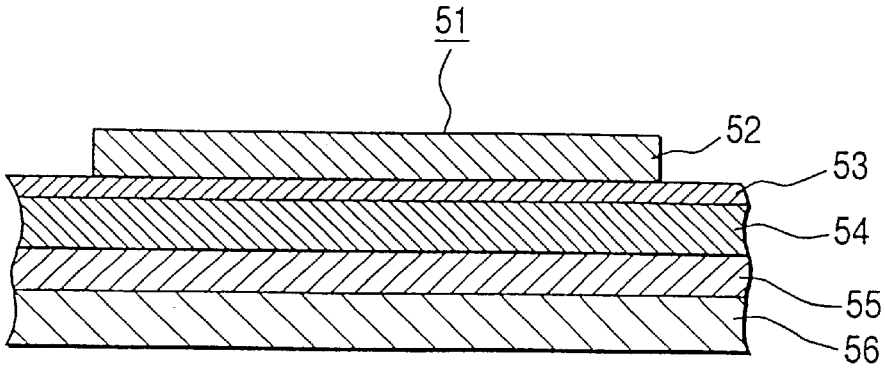
FIG. 6 is a sectional view showing a lamination construction of a transfer ribbon used in Embodiment 2 of the thermal transfer recording apparatus of the present invention.

FIG. 6 is a sectional view showing a lamination construction of a transfer ribbon used in the thermal transfer recording apparatus of the present invention. In FIG. 6, the transfer ribbon 51 has a protective layer 56 base of which comprises a base material 55 of a transparent polyester resin film to thereby reduce a sliding resistance between contact surfaces of the thermal head 57 and the heat generating element 79. On the other hand, a heat sensitive layer 54 colored by heating is laminated on the opposite surface of the transfer ribbon 51, on the side in close contact with the recording sheet. In addition, an over-coating layer 53 is laminated on an upper layer of the layer 54, and a color ink resin layer section 52 is laminated on the layer 53. The number of colors colored by the heat sensitive layer 54 need not be particularly limited but any color capable of sensing shade by the optical sensor will do. The composition of ink used in the color ink resin layer section 52 is not different from that of the prior art.

Figure 7:
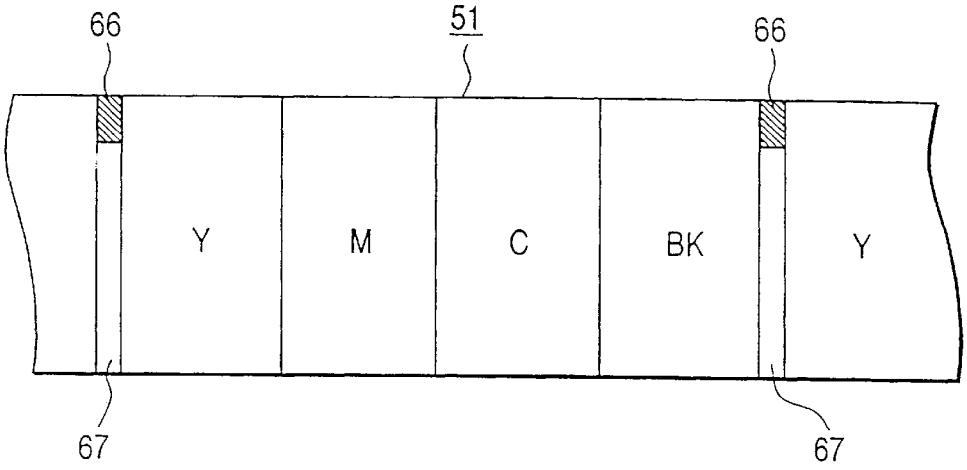
FIG. 7 is a view showing the arrangement of color ink resin layer sections and mark sections of a transfer ribbon in Embodiment 2 of the thermal transfer recording apparatus of the present invention.

FIG. 7 is a view showing the arrangement of color ink resin layer sections and mark sections of the transfer ribbon according to the present invention. In the transfer ribbon 51 according to the lamination construction shown in FIG. 6, there is shown an arrangement relation between color ink resin layer sections comprising a yellow Y section, a magenta M section, a cyan C section and a black BK section, and mark sections 67 marked with head marks 66 for discriminating a position of a yellow Y section which is a first color for one page. As shown the color ink resin layer sections have a width slightly beyond a recordable width, and are sequentially arranged in a longitudinal direction so that one page portion can be recorded in order of Y-M-C-BK The short mark section 67 is provided before the yellow Y section. The width dimension of the mark section 67 is the same as that of the color ink resin layer sections.

Figure 9:
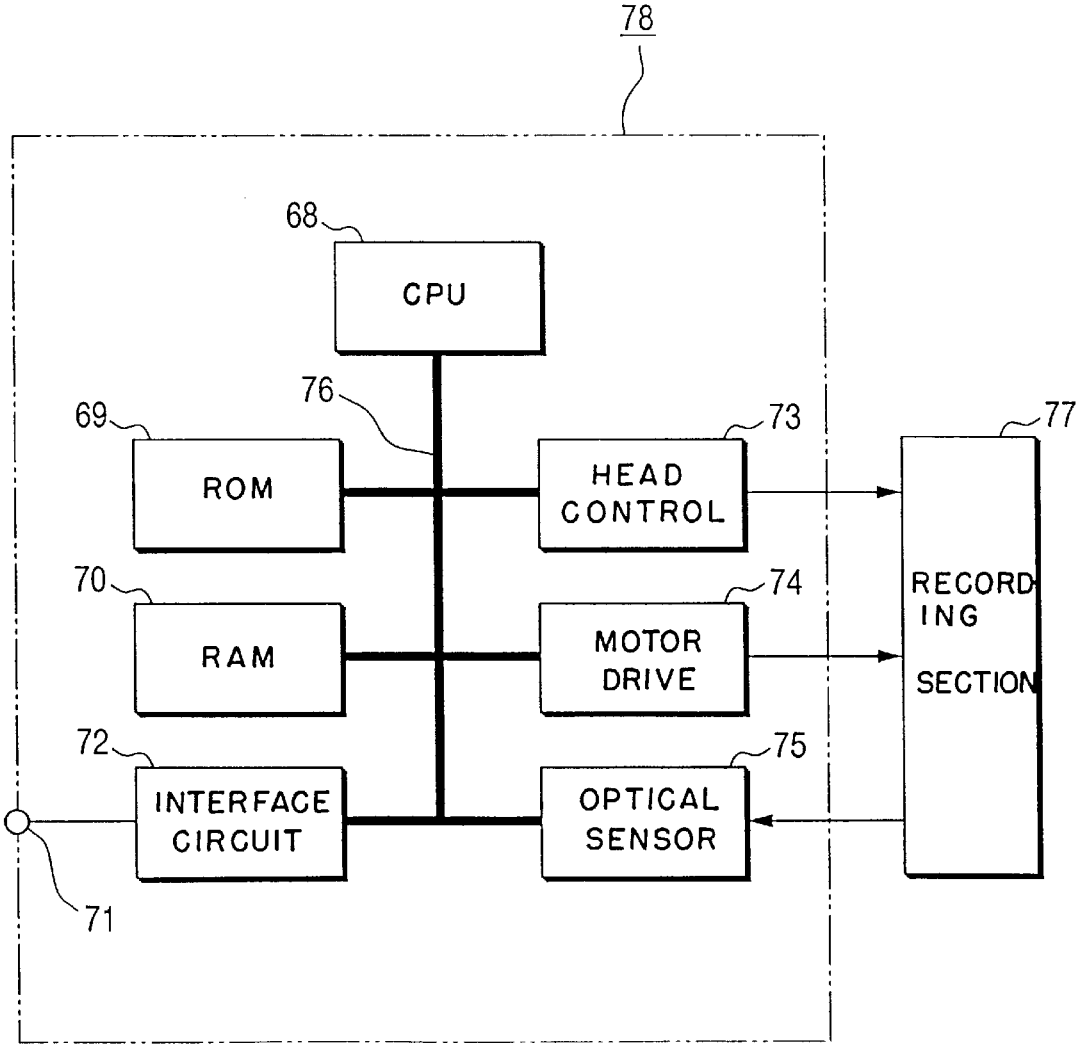
FIG. 9 is a block diagram showing the constitution of a controller in Embodiment 2 of the thermal transfer recording apparatus of the present invention.
Figure 10:
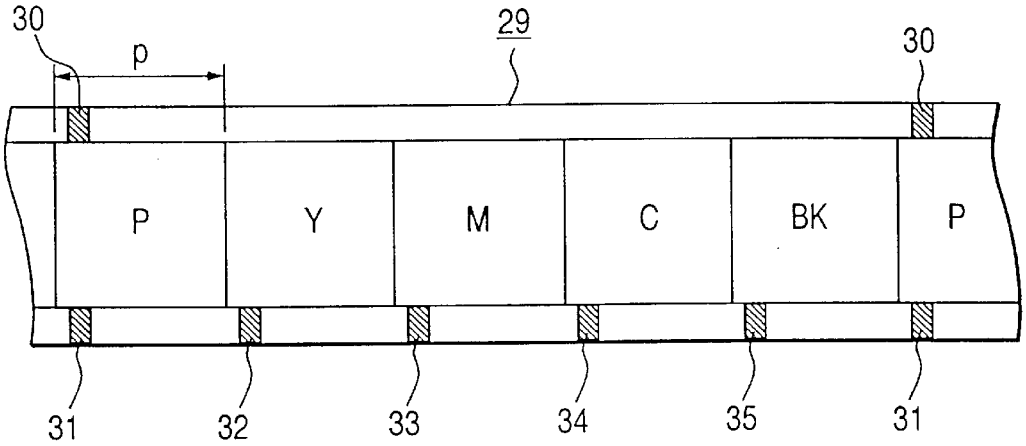
FIG. 10 RELATED ART
FIG. 10 is a view showing the arrangement of sections of a transfer ribbon according to Prior Example 1.
Figure 11:
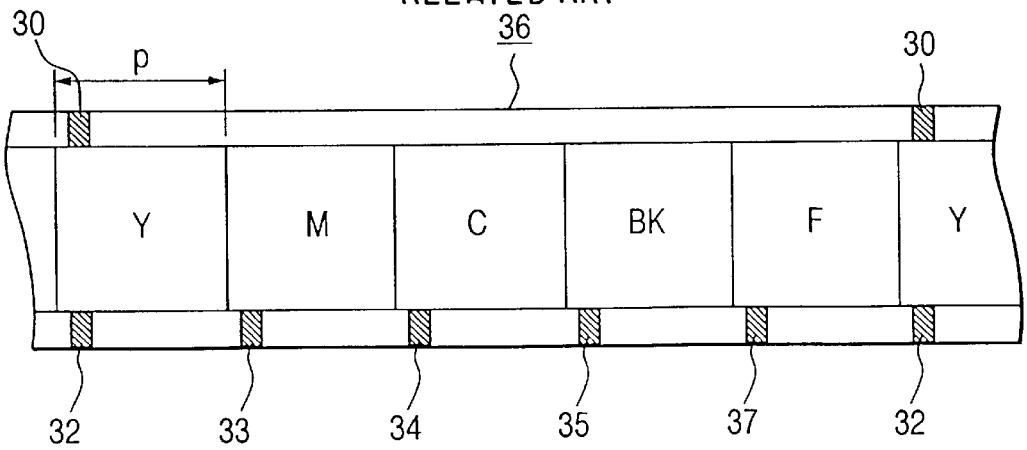
FIG. 11 RELATED ART
FIG. 11 is a view showing the arrangement of sections of a transfer ribbon according to Conventional Example 1.
Figure 12:
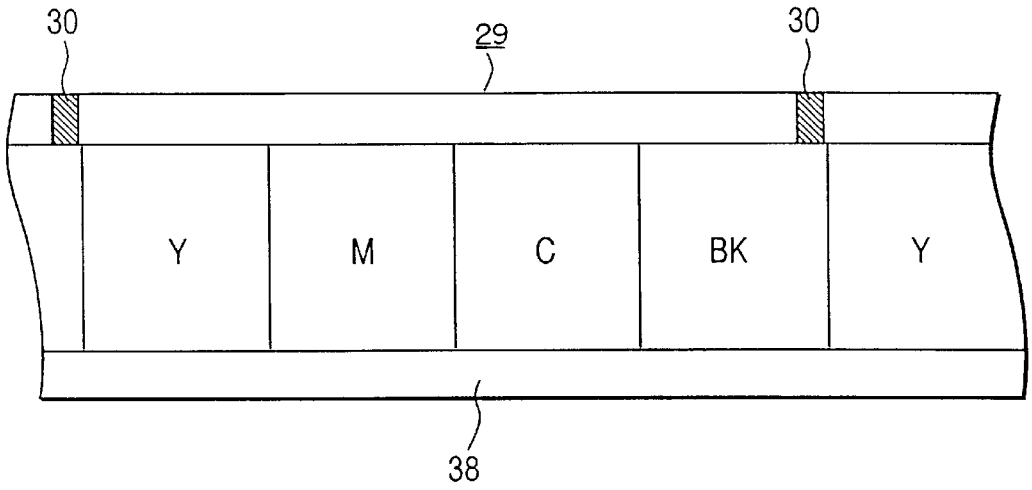
FIG. 12 RELATED ART
FIG. 12 is a view showing the arrangement of sections of a transfer ribbon according to Prior Example 2.
Figure 13:
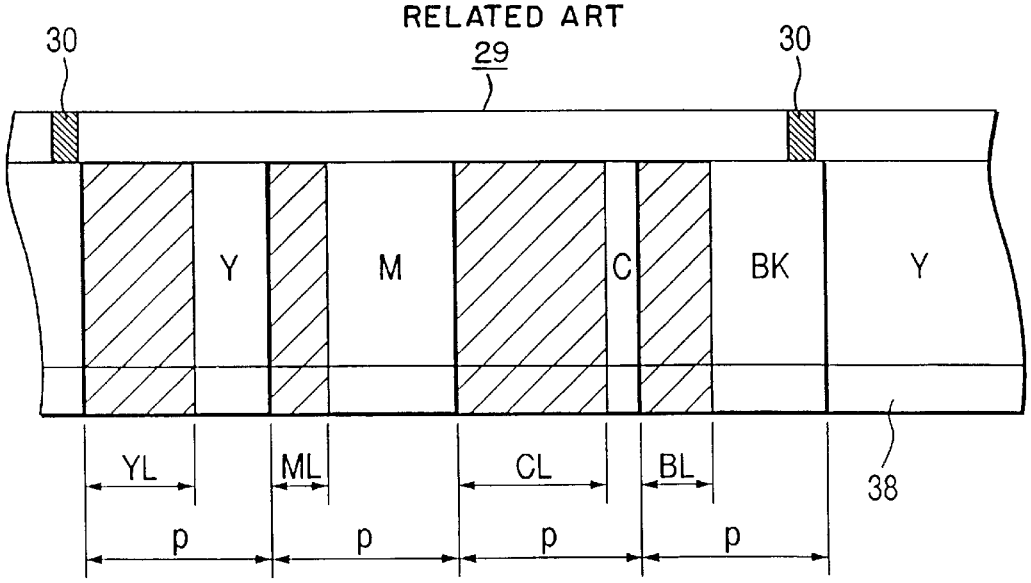
FIG. 13 RELATED ART
FIG. 13 is a view showing the used sections of color ink resin layer sections of a transfer ribbon in Prior Example 2.

FIG. 9 is a block diagram showing the internal constitution of a controller 78 incorporated in the thermal transfer recording apparatus in Embodiment 2 of the present invention. In FIG. 9, reference numeral 68 designates a central processing unit (CPU is short therefor); 69, a memory for storing a control program (ROM is short therefor); 70, a memory for storing image data input and internally processing data (RAM is short therefor); 71, an input/output connector connected to external host apparatus; 72, an interface circuit for the level exchange of input/output signals; 73, a head control circuit for controlling energization with respect to a heat generating element 79 of a thermal head 57 provided on a recording section 77; 74, a motor drive circuit provided in the recording section 77 to control a group of drive motors for a platen roller 60, a supply roll 58 and a take-up roll 59 of a transfer ribbon 51; 75, an optical sensor processing circuit provided in the recording section 77 to process signal generated from a light receiving element 65; and 76, an internal bus which is a delivery channel of various signals.

The actual thermal transfer recording operation is carried out as follows: Image data to be recorded is input from the external host apparatus through the input/output connector 71 and is converted into a signal level suitable for the internal processing by the interface circuit 72. This signal is analyzed by the CPU 68 in accordance with a data processing procedure stored in the ROM 69 and is stored in the RAM 70 as various color recording data Under this stage, the controller 78 is capable of grasping the length used in the color ink resin layer sections of the transfer ribbon 51, and the length of the unused sections remained after use. Corresponding to the recording data of colors stored in the RAM 70, the CPU 68 outputs the energization instructions with respect to the heat generating element 79 to the head control circuit 73 and at the same time suitably outputs the drive instructions to the motor drive circuit 74 so as to control the group of motors in the recording section 77. A signal generated from the light receiving element 65 is delivered to the internal bus 76 via the optical sensor processing circuit 75 as light emitted by the light emitting elements 62 arranged at predetermined positions close to both ends of the recording width of the transfer ribbon 51.

Figure 8:
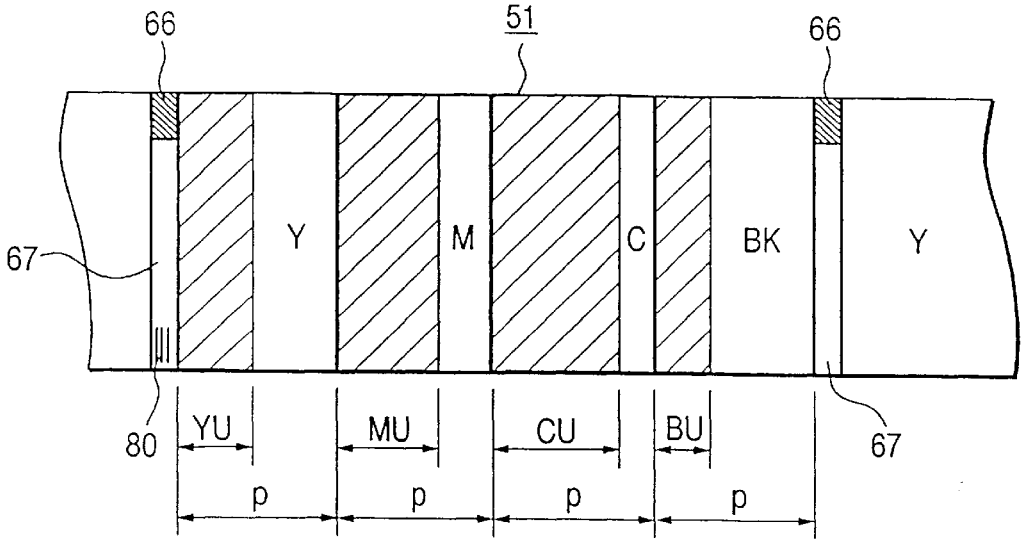
FIG. 8 is a view showing the used sections of color ink resin layer sections and mark sections of a transfer ribbon in Embodiment 2 of the thermal transfer recording apparatus of the present invention.

The CPU 68 is provided with two sets of detection means capable of grasping a feed position of the transfer ribbon 51 by monitoring the signal. Accordingly, the controller 8 is provided with data processing means for outputting the energization instructions to the heat generating element 79 with respect to the head control circuit 79 on the basis of used or unused information in the corresponding color ink resin layer section before the recording to image data FIG. 8 shows the state of the transfer ribbon 51 after the transfer recording has been executed by the controller 78 constructed as described above. FIG. 8 is a view showing the used section in the color ink resin layer sections of the transfer ribbon according to Embodiment 2 of the present invention.

According to FIG. 8, as a result of recording an image for one page, the yellow Y section by length YU, the magenta M section by length MU, the cyan C section by length CU and the black BK section by length BU are respectively consumed in the transfer ribbon 51 from the color ink resin layer sections having a length p. Bar codes 80 corresponding to YU, MU, CU, BU or (p-YU), (p-MU), (p-CU), (p-BU) of the sections can be written in advance in the mark section 67 before the transfer recording of image data by the function of the data processing means of the controller 78. As previously mentioned, since the transparent substrate 55 of the transfer ribbon 51 is provided with the heat sensitive layer 54 colored by heating, the bar code 80 written by the energization instructions to the heat generating element 79 transmitted from the data processing means is represented by color which cuts off light, for example, black.

In the process of heat transfer recording with respect to a next page, first, the transfer ribbon 51 is fed by a predetermined amount in a rewinding direction, and the head mark 66 of the black BK section is discriminated by one of the detection means to confirm the head position of the yellow section. At the same time, the bar code 80 is read by the other detection means to determine a usable length of the color ink resin layer sections. If the length of the unused section of the color ink resin layer sections to be recorded has room on the basis of the result of determination an additional writing is made on the bar code 80 so as to correspond to the length consumed at this time, and the transfer recording using the color ink resin layer section is executed. If there is no room, the winding operation of the transfer ribbon 61 to the color ink resin layer section corresponding to next page is carried out.

Since the practical use of the unused portion of the color ink resin layer sections is accompanied by the rewinding and winding of the transfer ribbon 51, it is limited in advance by a control program so as to be remained in the range of a few pages in consideration of the recording processing rate. Upon termination of transfer recording using the yellow Y section, the recording sheet 11 is located at a predetermined position, and the thermal transfer recording using the magenta M section, the cyan C section, and the black BK section is continuously executed repetitively by the similar procedure.

While in the embodiments according to the present invention, a description has been made of the color ink resin layer sections of the transfer ribbon 51 used in the thermal transfer recording of image data on the basis of 4-color constitution of yellow, magenta, cyan and black, it is obvious that even 3-color constitution except black, the effect of the present invention is not at all affected, and even if the constitution of the head mark and the bar code are variously modified, the intended function can be obtained.

The present invention has the following effects:

1. The thermal transfer recording apparatus according to a first invention is a thermal transfer recording apparatus in which desired transfer ribbons out of a plurality of transfer ribbons are alternately charged to perform recording on a recording sheet. At least one transfer ribbon out of said plurality of transfer ribbons is alternately provided with white or transparent precoating resin layer sections capable of being peeled off by heating on a film-like heat resistant substrate and transparent protective coating resin layer sections in a longitudinal direction whereby thermal transfer by the precoating resin layer section is carried out before recording of a visual image on the recording sheet, and after the visual image has been recorded on the recording sheet, thermal transfer by the protective coating resin section can be performed.

Thereby, it is possible to exchangeably use a first transfer ribbon provided on the color ink resin layer section and a second transfer ribbon in which the precoating resin layer sections and the protective coating resin layer sections are sequentially set in a longitudinal direction. The number of fabrication steps for transfer ribbons is reduced to enhance the yield. The apparatus for bonding resin layers is prevented from being larger in size, and an inexpensive transfer ribbon can be used. As a consequence, the operational expenses of the thermal transfer recording apparatus can be reduced. Further, since there is provided a discrimination mark capable of discriminating at least one of the precoating resin layer and the protective coating resin layer, in the thermal transfer recording apparatus according to the present invention, it is possible to automatically discriminate both the resin layer sections to automatically execute fixed transfer processing, thus improving the operational property of the thermal transfer recording apparatus.

2. Further, the second thermal transfer recording apparatus according to a second invention can record use of unused information of color ink resin layer sections sequentially arranged in a longitudinal direction with a predetermined area and color ink resin layer sections at ends widthwise, and further comprises a transfer ribbon provided with a mark section with a head mark for discriminating head color of the color ink resin layer section, data processing means for outputting instructions for recording said information related to the color ink resin layer sections with respect to the mark section, and detection means for defecting used or unused information of the color ink resin layer sections, whereby the thermal transfer recording can be carried out with the used and the unused section of the color ink resin layer sections on the basis of the information from the detection means.

With this, since the unused portion of the color ink resin layer section can be re-used, the width of the transfer ribbon need not be widened, but the transfer ribbon can be used economically. Further, the length of the thermal head can be shortened to reduce the cost due to the miniaturization of the thermal transfer recording apparatus and reduce the operational expenses.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A thermal transfer recording apparatus for holding a transfer ribbon and a recording sheet between a thermal head having a heat generating element and a platen roller so that information is recorded on said recording sheet through said transfer ribbon by an output signal to said heat generating element, comprising:

a transfer ribbon including a plurality of color ink resin layer sections sequentially arranged in a longitudinal direction to record a visual image on said recording sheet by heating and a mark section including a discrimination mark for discriminating a head color of said color ink resin layer sections and a marking section for recording information of a used section or unused section in said color ink resin layer sections, said mark section extending widthwise across said transfer rn ribbon means for detecting the used section or unused section in said color ink resin layer sections; and data processing means for outputting recording instruction of said information related to said color ink resin layer sections to the marking section, said unused section being used to perform the heat transfer recording on the basis of information from said detection means.

2. The thermal transfer recording apparatus according to claim 1, wherein each of said plurality of color ink resin layer sections extends generally entirely across the width of said transfer ribbon.

3. The thermal transfer recording apparatus according to claim 1, wherein said recording information is in the form of a bar code written in said marking section, said bar code indicating to said detecting means the amount used or unused of said color ink resin layer sections.

4. The thermal transfer recording apparatus according to claim 3, wherein said bar code is written on a first widthwise side of said transfer ribbon and said discrimination mark is located on a second, opposite widthwise side of said transfer ribbon.

5. The thermal transfer recording apparatus according to claim 4, further comprising means for detecting said discrimination mark located on said second widthwise side of said transfer ribbon, said means for detecting the used section or unused section in said color ink resin layer sections being located on said first side of widthwise said transfer ribbon.

6. The thermal transfer recording apparatus according to claim 1, wherein there are a plurality of said mark sections spaced longitudinally along said transfer ribbon with said color ink resin layer sections located therebetween.

7. The thermal transfer recording apparatus according to claim 6, wherein there are a plurality of groups of said color ink resin layer sections and each of said mark sections corresponds to one of said group of colored ink resin layer sections and includes recording information in the marking section thereof to indicate the amount used or unused of each of said colored ink resin layer sections respectively.

* * * * *